US012546125B2

(12) United States Patent
Balue

(10) Patent No.: US 12,546,125 B2
(45) Date of Patent: Feb. 10, 2026

(54) SCAFFOLDING TIES

(71) Applicant: Avestin Limited, Honiton (GB)

(72) Inventor: Gavin Balue, Honiton (GB)

(73) Assignee: Avestin Limited (GB)

( * ) Notice: Subject to any disclaimer, the term of this patent is extended or adjusted under 35 U.S.C. 154(b) by 309 days.

(21) Appl. No.: 18/044,636

(22) PCT Filed: Sep. 15, 2021

(86) PCT No.: PCT/GB2021/052396
§ 371 (c)(1),
(2) Date: Mar. 9, 2023

(87) PCT Pub. No.: WO2022/058730
PCT Pub. Date: Mar. 24, 2022

(65) Prior Publication Data

US 2023/0332419 A1 Oct. 19, 2023

(30) Foreign Application Priority Data

Sep. 15, 2020 (GB) ..... 2014482

(51) Int. Cl.
*E04G 5/12* (2006.01)
*E04G 5/14* (2006.01)
*E04G 21/24* (2006.01)

(52) U.S. Cl.
CPC ..... *E04G 5/12* (2013.01); *E04G 5/14* (2013.01); *E04G 21/24* (2013.01); *E04G 2021/248* (2013.01)

(58) Field of Classification Search
CPC ..... E04G 21/26; E04G 17/002
USPC ..... 182/82, 230; 52/127.2
See application file for complete search history.

(56) References Cited

U.S. PATENT DOCUMENTS 2,301,306 A * 11/1942 Mcdonald ..... E04G 17/14 249/207
2,832,559 A * 4/1958 Hillberg ..... E04G 21/26 254/98
6,112,475 A * 9/2000 Truitt ..... E04G 21/26 52/150
7,275,731 B1 * 10/2007 Shinault ..... E04G 25/06 248/354.5
2006/0207215 A1 * 9/2006 Bruno ..... E04G 17/14 52/745.12

(Continued)

FOREIGN PATENT DOCUMENTS

DE 2134492 A1 1/1973
DE 3204654 A * 8/1983 ..... E04G 21/28
DE 3204654 A1 8/1983

*Primary Examiner* — Babajide A Demuren
(74) *Attorney, Agent, or Firm* — Endurance Law Group PLC; James R. Yee

(57) ABSTRACT

An improved scaffolding tie (1*c*) for connecting a scaffolding tarpaulin (8) to a scaffolding pole (9) is disclosed. The tie (1*c*) comprises an anchor (4*c*) for anchoring the tie (1*c*) to the scaffolding tarpaulin(S), an attachment portion (6*c*) for attaching the tie (1*c*) to a scaffolding pole (9), and a ligament (5*c*). The ligament (5*c*) is connected between the anchor (4*c*) and the attachment portion (6*c*) and arranged, in use, to bias the anchor and attachment portion towards one another. The attachment portion (6*c*) comprises a fastening means (2*c*) and a connector piece (60*c*) arranged, in use, to reversibly connect to one another to form a loop around a scaffolding pole (9).

19 Claims, 8 Drawing Sheets

(56) References Cited

U.S. PATENT DOCUMENTS

2020/0181927 A1* 6/2020 Balue ..... F16B 2/08

* cited by examiner

SCAFFOLDING TIES

RELATED APPLICATIONS

This application is a national stage application of WO PCT/GB2021/052396, filed on Sep. 15, 2021, which claims priority to GB Patent Application 2014482.0, filed Sep. 15, 2020, the entire disclosures of which is hereby incorporated by reference and relied upon.

FIELD OF THE INVENTION

The present invention relates to a scaffolding tie. In particular, the present invention relates to a scaffolding tie for connecting a scaffolding tarpaulin to part of a scaffolding structure such as a scaffolding pole.

BACKGROUND TO THE INVENTION

During external repair or other such construction work on buildings, a scaffolding structure is typically constructed in the region of the building requiring work. Scaffolding tarpaulins are then connected to scaffolding poles of the structure so as to protect the building and workers on the scaffolding structure from adverse environmental conditions, and also protecting against the danger of falling debris.

Scaffolding tarpaulins are connected to scaffolding poles by way of scaffolding ties. Prior-known scaffolding ties generally comprise an anchor, a hook and an elasticated cord between the anchor and hook. An example of such a prior-known tie is disclosed in European publication number 0310850 the content of which is hereby incorporated by reference to the extent permissible by applicable law.

Such prior-known ties suffer from a number of drawbacks.

The cord between the anchor and the hook of such ties generally need to be long enough to enable it to extend from the tarpaulin to the scaffolding pole, and then looped around that scaffolding pole so that the hook can hook over the cord. The cord is a relatively expensive component of a tie, and so the need for such length increases the overall cost of a tie.

Furthermore, a long length combined with the elasticity of the cord means that the cord often has to be wound several times around the scaffolding pole to establish sufficient tautness to securely retain the scaffolding tarpaulin to the scaffolding pole. This is inconvenient and time-consuming for a scaffolder. Moreover, this can also compromise safety, especially if the scaffolder is having to maintain a constant force on the cord whilst winding the cord; doing so can unbalance the scaffolder.

Additionally, each time the cord is wound around a scaffolding pole represents a step-change in the tension in the cord. Accordingly, this can make it difficult to achieve the best level of tension in the cord. The correct level of tension may be achievable only via a half-turn of the cord around the pole, but this is impractical as a full turn is necessary to loop the hook around to meet with the unwound portion of the cord that extends between the pole and the anchor. Another associated issue is that the hook is able to slip along the length of the cord. This causes the tie to loosen after hooking, potentially causing disengagement.

Prior to deconstruction of a scaffolding structure, a scaffolding tarpaulin needs to be decoupled from scaffolding poles. If prior-known scaffolding ties are to be reused, then a reverse operation of disengaging the hook and unwinding the cord is necessary to achieve the decoupling. This is also time-consuming and inconvenient. In practice, to save time, the cord of prior-known scaffolding ties are simply cut to achieve the quick release of the tarpaulin. This is wasteful and adds to the expense of implementing scaffolding.

An improvement conceived by the inventor of the present application that addresses these issues is disclosed in International publication number WO 2018/011574 the content of which is hereby incorporated by reference to the extent permissible by applicable law. Nonetheless, the inventor has conceived further improvements to the scaffolding tie disclosed in WO 2018/011574, and it is against this background that the present invention has been devised.

SUMMARY OF THE INVENTION

According to a first aspect of the present invention there is provided a scaffolding tie for connecting a scaffolding tarpaulin to a scaffolding pole. Preferably, the tie comprises at least one of an anchor for anchoring the tie to the scaffolding tarpaulin, an attachment portion for attaching the tie to a scaffolding pole, and a ligament connected between the anchor and the attachment portion. Preferably, the ligament is arranged, in use, to bias the anchor and attachment portion towards one another. Moreover, the ligament is preferably arranged to bias the anchor and attachment portion towards one another when the tie is in use, and the ligament is under tension-such as when it is tensioned around a scaffolding pole.

Preferably, the attachment portion comprises a fastening means and a connector piece arranged, in use, to reversibly connect to one another to form a loop around a scaffolding pole.

Preferably, the fastening means and the connector piece comprise complementary interconnection structures. The complementary interconnection structures are arranged to slide along one another between a connected configuration in which the fastening means and the connector piece are connected to one another and a disconnected configuration in which the fastening means and the connector piece are disconnected from one another.

The interconnection structures may comprise rails along which at least one of the fastening means and the connector piece are slidable relative to the other.

The interconnection structures may comprise at least one of a latch and a keep. The latch may be receivable within the keep and retained therein when the fastening means and the connector piece are connected to one another.

The interconnection structures may comprise registration formations. The registration formations may be arranged to register the fastening means and the connector piece relative to one another when they are in the connected configuration. The registration formations may be arranged to provide tactile feedback to user when the fastening means and the connector piece are moved into or out from the connected configuration.

The registration formations may be arranged to alter the force required to decouple the interconnection structures. The registration formations may be arranged to alter the sliding frictional force that is required to move the fastening means and the connector piece into or out from the connected configuration. The sliding frictional force may be greater than that required to move the fastening means and the connector piece between the disconnected configuration and the connected configuration.

The fastening means and the connector piece may be arranged to latch on to one another when in a connected configuration.

Preferably, the ligament is arranged, in use, to bias the fastening means and connector piece towards a connected configuration.

Preferably, the fastening means and the connector piece each comprise a barrel portion.

Each barrel portion may comprise a bore into which respective ends of the ligament are received and permanently connected to the fastening means or the connector piece.

Preferably, the ligament is permanently connected to at least one the fastening means and connector piece via at least one pin. The pin may comprise a staple or another similar pinning structure, such as a nail. The pin may extend through the ligament and the barrel portion of the at least one of the fastening means and connector piece. Preferably, the pin extends through the barrel portion at an angle transverse to a longitudinal axis of the barrel portion. Preferably, the bore of the barrel portion is a blind bore. Advantageously this limits insertion of the ligament into the barrel portion during manufacturing, increasing the reliability of the manufacturing process.

Preferably, an open end of each barrel portion from which a respective end of the ligament emerges is spaced from respective interconnection structures of the fastening means or the connector piece.

Preferably, the fastening means and the connector piece each comprise a respective rear part which are each arranged so that squeezing the rear part together, when the fastening means and the connector piece are interconnected, slides the fastening means and the connector piece along one another toward a disconnected configuration.

Preferably, at least one of the rear parts comprise finger grips shaped and arranged to facilitate manual handling of the tie. The scaffolding tie may be shaped and arranged to allow the rear parts to be squeezed together using a thumb and forefinger of a user, thereby to allow one-handed decoupling of the fastening means and the connector piece.

Preferably, the anchor comprises at least one anti-slippage structure arranged to prevent slippage of the anchor relative to the ligament, when the tie is in an anchoring configuration, and the ligament extends in an orientation transverse to the anchor. This can impede disengagement of the anchor from the scaffolding tarpaulin through which the anchor is threaded, especially when the tie is in tensioned use.

Preferably, the at least one anti-slippage structure comprises at least one groove defined within the anchor, in which the ligament is accommodated when the tie is in an anchoring configuration. Preferably, the groove is located at a relatively narrow part of the anchor.

The scaffolding tie may comprise a pair of anti-slippage structures, each for accommodating a different portion of the ligament.

The ligament may comprises an elastic elongate member, such as a bungee shock cord. Moreover, the ligament may be the elastic elongate member. In certain alternatives, the ligament may constructed from another elastomeric material, at least in part.

Preferably, at least one of the anchor, the fastening means, and the connector piece are constructed from an integral piece of material. At least one may be moulded from an integral piece of material. The material may be a relatively inelastic plastics material.

Preferably, the anchor is elongate between a base at one end of the anchor, to an apex at the other end of the anchor. Ideally, the apex is suitable for puncturing an opening in a scaffolding tarpaulin through which the anchor is to be threaded. The apex may taper to a point or an edge. In alternatives, the apex may have other piercing constructions. For example, the apex may be shaped in the form of a drill bit. Preferably, the base provides a broad contact surface to facilitate the comfortable manual application of pressure to enable the apex to puncture an opening in the scaffolding tarpaulin.

Preferably, the connector piece comprises a body that defines a curved contact surface. In use, the curved contact surface substantially conforms to a cylindrical outer surface of a scaffolding pole. A circular loop may be defined by the combination of a fastening means and the contact surface of the body. The body of the connector piece may be ribbed for strength.

According to a second aspect of the present invention there is provided a scaffolding kit comprising a scaffolding pole, a scaffolding tarpaulin, and at least one scaffolding tie according the first aspect of the present invention.

According to a third aspect of the present invention, there may be provided a method of using a scaffolding tie according to the first and/or second aspect of the present invention.

A fourth aspect of the present invention may reside in a method of manufacturing a scaffolding tie according to the first and/or second aspect of the present invention.

Naturally, aspects of the present invention may extend to a plurality of scaffolding ties according to the first aspect of the present invention. Moreover, aspects of the present invention may reside in a scaffolding kit comprising one or more scaffolding poles, one or more scaffolding tarpaulins and a plurality of scaffolding ties according to the first aspect of the present invention. In practice, the plurality of scaffolding ties may be arranged to connect the one or more scaffolding tarpaulins to the one or more scaffolding poles, so as to form a sheltered scaffolding structure.

It will be understood that features and advantages of different aspects of the present invention may be combined or substituted with one another where context allows. For example, the features of the fastening means described in relation to the first aspect of the present invention may be present on the fastening means described in relation to the second aspect of the present invention. Furthermore, such features may themselves constitute further aspects of the present invention. For example, the anchor, the ligament and/or the attachment portion may constitute further aspects of the present invention.

BRIEF DESCRIPTION OF THE DRAWINGS

In order for the invention to be more readily understood, embodiments of the invention will now be described, by way of example only, with reference to the accompanying drawings in which.

SPECIFIC DESCRIPTION

Figure 1:
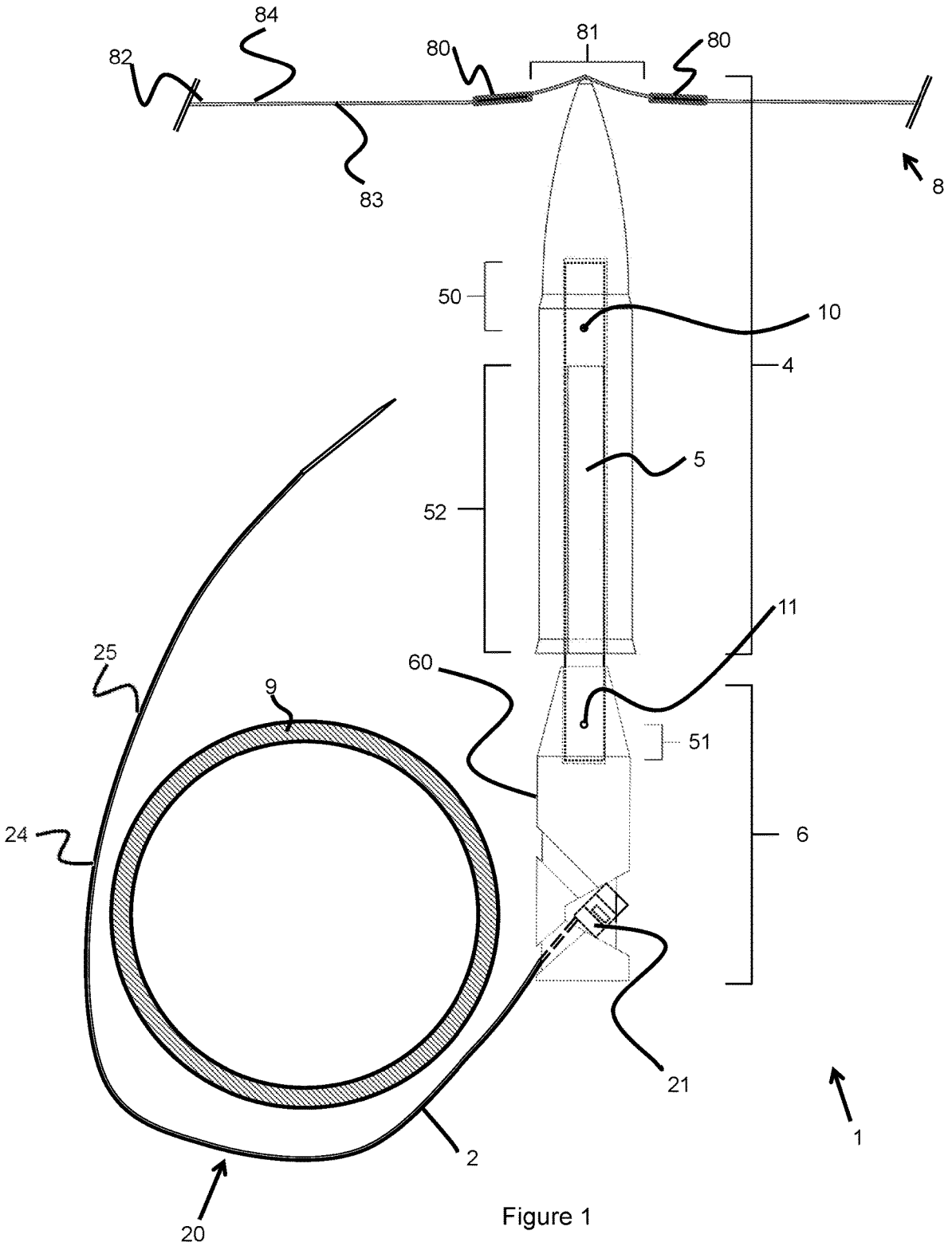
FIG. 1 is a lateral schematic view of the scaffolding tie of WO 2018/011574 that is useful in understanding a first embodiment of the present invention, the scaffolding tie being shown schematically together with a scaffolding pole and a scaffolding tarpaulin, and the scaffolding tie being in a threading configuration.
Figure 2:
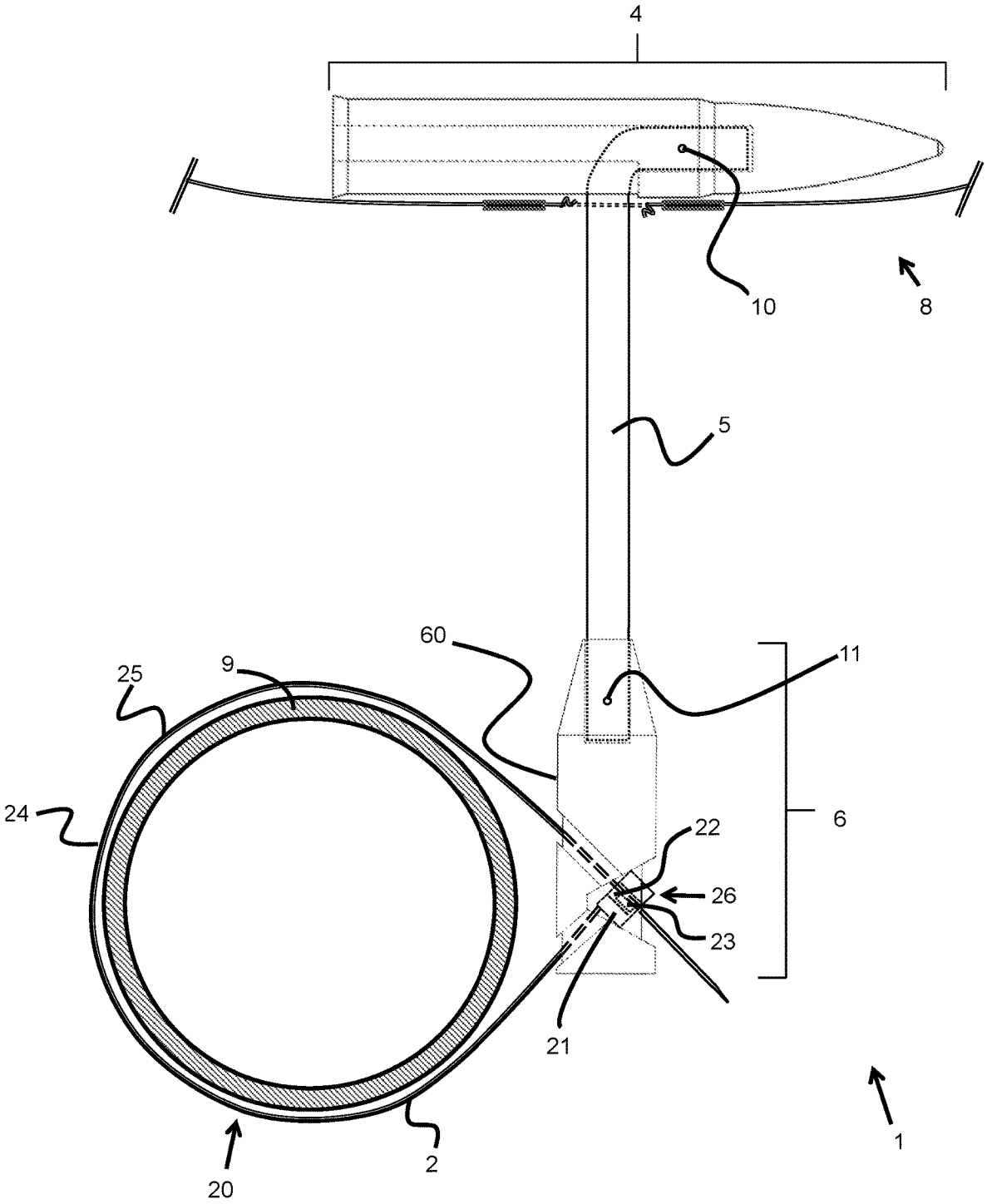
FIG. 2 shows a similar view to FIG. 1, but with the scaffolding tie being in an anchoring configuration.
Figure 3:
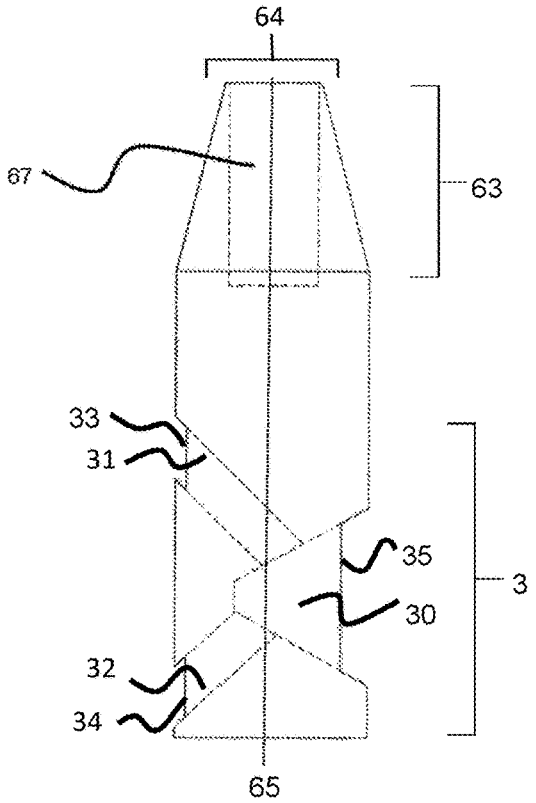
FIG. 3 is a lateral schematic view of a connector piece of the scaffolding tie of FIG. 1.
Figure 5:
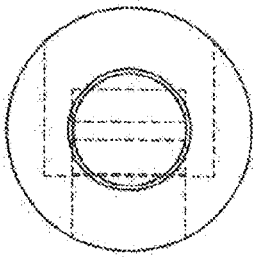
FIG. 5 is an end schematic view of the connector piece of FIG. 3.
Figure 4:
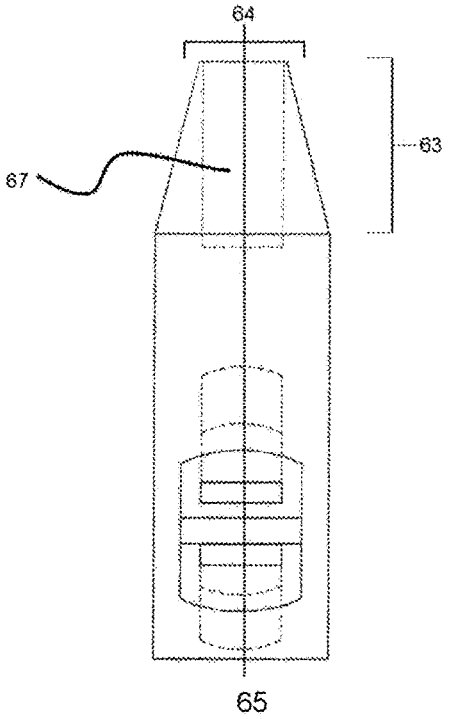
FIG. 4 is a front schematic view of the connector piece of FIG. 3.
Figure 6:
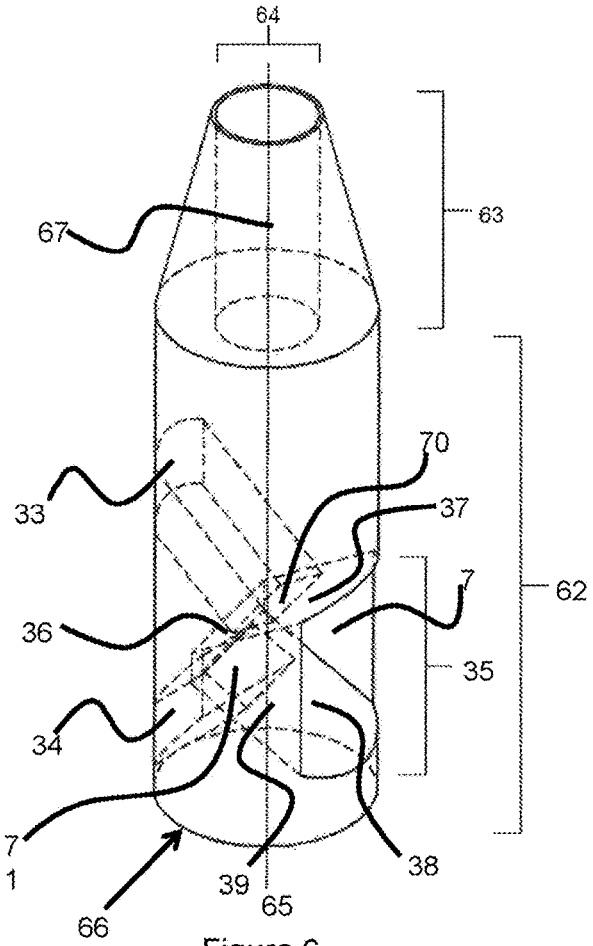
FIG. 6 is a perspective schematic view of the connector piece of FIG. 3.

FIG. 1 is a schematic view of a scaffolding tie 1 of WO 2018/011574 that is useful in understanding a first embodiment of the present invention, the tie 1 being shown prior to connection between a scaffolding tarpaulin 8 and a scaffolding pole 9. FIG. 2 show a similar schematic view to that of FIG. 1, but with the scaffolding tie 1 connected to the scaffolding tarpaulin 8 and the scaffolding pole 9, biasing them towards one another as will be described in greater detail below.

Referring to FIGS. 1 and 2, the tie 1 comprises an anchor 4, an attachment portion 6 and an elastic ligament 5 in the form of a bungee cord connected between the anchor 4 and the attachment portion 6. More specifically, the attachment portion 6 comprises a connector piece 60 and a fastening means 2, the ligament 5 being attached to the connector piece 60 so that the connector piece 60 connects between the ligament 5 and the fastening mean 2. The tie 1 also comprises a first pin 10 and a second pin 11 for connecting the ligament 5 to the anchor 4 and the connector piece 60 respectively.

The fastening means 2 has the general form of a cable tie, and so comprises an enlarged head 21 that defines a mouth 22 through which a tail 20 of the fastening means 2 can be threaded. The head 21 comprises an integral locking member 23 disposed within the mouth 22. The tail 20 of the fastening means 2 comprises a band-like portion 24 that has a cross-section substantially corresponding to the cross-sectional size of the mouth 22 of the head 21 of the fastening means 2. Integrally-formed on an inside surface of the band-like portion 24 are equidistantly arranged ribs 25 that cooperate with the locking member 23 disposed within mouth 22 to define a ratchet mechanism 26 to allow the fastening means to form a constrictable loop.

FIGS. 3 to 6 are various views of the connector piece 60 of the tie 1 of FIG. 1, the connector piece 60 being shown in isolation. The connector piece 60, which is formed from an inelastic integral piece of injection-moulded plastic, is elongate along a central axis 65 and has a broadly cylindrical body 62 that transitions into a frustoconical nose 63. The upper end 64 of the nose 63 opens to define a cylindrical blind bore 67 which extends axially partway into the connector piece 60. The bore 67, the body 62 and the nose 63 of the connector piece 60 share the central axis 65 as a common axis. The body 62 of the connector piece 60 terminates at a flat circular end 66 at its lower end.

The body 62 of the connector piece 60 defines, between the circular end 66 and the nose end 63, a chamber 3 which generally extends transverse to the central axis 65. Moreover, the chamber 3 comprise a trench 30, a first slot 31 and a second slot 32 which interrupt independent regions of the outer cylindrical surface 62*a* of the body 62 of the connector piece 60, and so define three openings therein; a first opening 33 corresponding to the first slot 31, a second opening 34 corresponding to a second slot 32, and a third opening 35 corresponding to the trench 30. The trench 30, first slot 31, and second slot 32, extend inwardly from their respective openings 35, 33, 34 towards one another and so communicate with one another within the body 62 of the connector piece 60. The first and second openings 33, 34 respectively associated with the first slot 31 and second slot 32 interrupt the outer cylindrical surface 62*a* of the body 62 of the connector piece 60 at axially-spaced, but circumferentially-aligned positions to one another. The third opening 35 associated with the trench 30 is disposed at a circumferentially opposed position relative to the first and second openings 33, 34. Thus the chamber 3, generally extends transverse to the central axis 65, with one entrance defined by the third opening 35, and two exits defined by the first and second openings 33, 34. The third opening 35 is axially positioned between the first and second openings 33, 34, and so the second opening 34 is closest to the circular end 66 of the body 62, and the first opening 33 is the most distal from the circular end 66 of the body 62.

The trench 30 is broadly in the shape of a trapezoidal prism, and tapers in towards the interior of the body 62 of the connector piece 60. At its narrowest, the trench 30 forms a flat rectangular gully 36 which is surrounded by trench walls that extend between edges of the gully 36, and edges of the third opening 35. Specifically, a first trench wall 37 and a second trench wall 38 together define a pair that are inclined relative to one another, sloping inwardly from respective curved edges of the third opening 35 to respective edges of the gully 36, thereby defining the inward taper of the trench 30. A third trench wall 39*a*, and a fourth trench wall 39*b* are each in the shape of an isosceles trapezium, and are congruent and parallel to one another, and extend along parallel trench planes 39*c*, 39*d* that are aligned with and equispaced from the central axis 65.

The first slot 31 and the second slot 32 each define linear paths of rectangular cross-section, the cross-section of each path being broadly the same as one another. The first and second slots 31, 32 are commonly bounded by a pair of parallel slot planes 31*a*, 31*b*, that are aligned with and equispaced from the central axis 65. The slot planes 31*a*, 31*b* are also parallel to, and disposed between the trench planes 39*c*, 39*d*, and so the first and second slot openings 33, 34 are circumferentially narrower than the trench opening 35.

The first and second slots 31, 32 extend transverse to the central axis 65, along paths that meet at an intersection within the internal volume defined by the trench 30. Moreover, the first slot 31 extends from the first opening 33 to the first trench wall 37 such that a first rectangular aperture 70 interrupts the first trench wall 37 at a central region of the first trench wall 37. The second slot 32 extends from the second opening 34 to the second trench wall 38 such that a second rectangular aperture 71 interrupts the second trench wall 38 at a deep region of the second trench wall 38, with the second rectangular aperture 71 sharing an edge with the gully 36 of the trench 30. Thus, the first and second slots 31, 32 lead into the trench 30 at offset positions.

Figure 7:
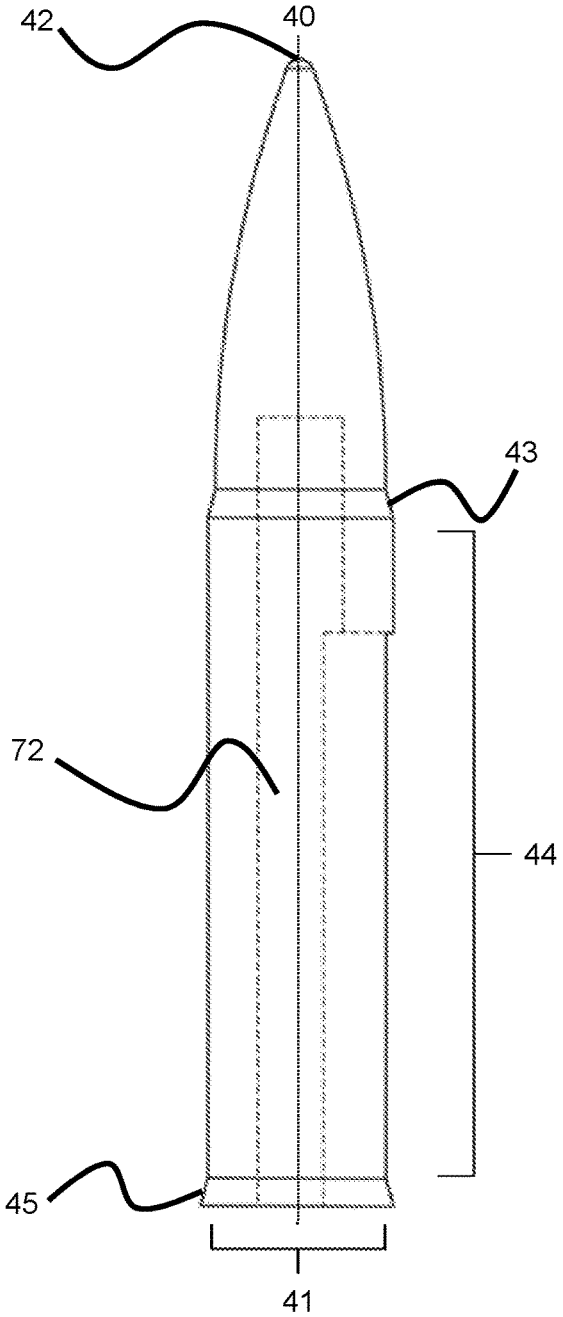
FIG. 7 is a lateral schematic view of an anchor of the scaffolding tie of FIG. 1.
Figure 8:
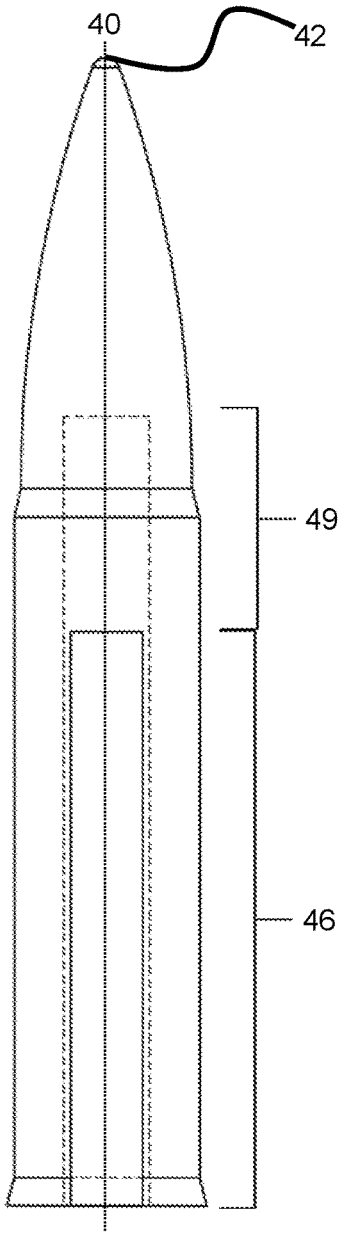
FIG. 8 is a front schematic view of the anchor of FIG. 7.
Figure 9:
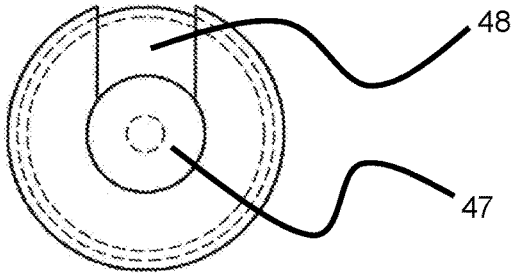
FIG. 9 is an end schematic view of the anchor of FIG. 7.

FIGS. 7 to 9 are various views of the anchor 4 of the tie 1 of FIG. 1, the anchor 4 being shown in isolation.

The anchor 4, which is formed from an inelastic integral piece of injection-moulded plastic, is elongate along a longitudinal axis 40 between a base 41 at one end of the anchor 4, to an apex 42 at the other end of the anchor 4. In the axial direction from the apex 42 to the base 41, the anchor 4 defines a dome 42*a*, a frustoconical collar 43, a cylindrical shank 44 and a frustoconical rim portion 45. The dome 42*a* follows the general contour of a prolate spheroid, tapering radially outward sharply at its axially-upper end, and tapering outward progressively less sharply towards its axially-lower end where the dome 42*a* meets the collar 43. In turn, the collar 43 tapers constantly outward to meet the shank 44 of the anchor 4. The shank 44 then extends with a regular outer circumference between the collar 43 and the rim portion 45. The frustoconical rim portion 45 then tapers constantly outward before terminating at the base 41. Thus, the anchor 4 is broadly bullet-shaped in its overall shape.

The anchor 4 defines a channel 46 that extends partway along the longitudinal length of the anchor 4 in alignment with the longitudinal axis 40 of the anchor 4, the channel 46 extending between the base 41 and a central region 72 of the anchor 4. The channel 46 broadly comprises a radially-inner cylindrical core 47, which is centred on the longitudinal axis 41, and a radially-outer broadly rectangular groove 48, the groove 48 interrupting the outer surface of the shank 44 and the rim 45. The core 47 and groove 48 partially overlap.

The anchor 4 also defines internal cylindrical blind bore 49 which is effectively an extension of the cylindrical core 47 of the channel 46, the bore 49 extending axially partway along the longitudinal length of the anchor 4 between the central region 72 of the anchor 4 and the apex 42. Thus the bore 49 and the channel 46 communicate with one another.

Referring back to FIGS. 1 and 2, a first end portion 50 of the ligament 5, which is recessed within the blind bore 49 of the anchor 4, is attached to the anchor 4 by way of the first pin 10 extending through the anchor 4 and the first end portion 50 of the ligament 5, pinning them to one another. Specifically, the first pin 10 extends through the shank 44 of the anchor 4, at a location that bisects the longitudinal axis 40. Thus, the pin 10 extends centrally through the first end portion 50 of the ligament 5, the first pin 10 spanning transversely across the blind bore 49 of the anchor 4. Similarly, a second end portion 51 of the ligament 5, which is recessed in the blind bore 67 of the connector piece 60 is attached to the connector piece 60 via the second pin 11 which extends transversely through the nose 63 of the connector piece 60 and the ligament 5, the second pin 11 spanning transversely across the blind bore 67 of the connector piece 60.

The typical use of the scaffolding tie 1 by a user will now be described. The user is generally a scaffolder.

FIG. 1 shows the scaffolding tie 1 in a threading configuration in which the ligament 5 extends in axial alignment with the anchor 4 so as to facilitate threading of the anchor 4 through a scaffolding tarpaulin 8. Moreover, the channel 46 is arranged to accommodate within the anchor 4 a stowable portion 52 of the ligament 5 so that the ligament 5 does not extend circumferentially beyond any radially-outwardly facing surface of the anchor 4, but rather extends axially from the base 41 of the anchor.

As is typical in the technical field of scaffolding, the scaffolding tarpaulin 8 comprises an eyelet 80 which forms a reinforced region of the scaffolding tarpaulin 8 to which the scaffolding tie can reliably attach. Initially, an eye 81 of the eyelet 80 is occluded by webbing 82 from which the tarpaulin 8 is predominantly constructed, and so the eye 81 does not form an opening that passes all the way through, from one side of the tarpaulin 8 to the other, but rather first requires puncturing.

Naturally, the tapered apex 42 of the anchor 4 is suitable for puncturing such an opening in the scaffolding tarpaulin 8. This is facilitated by the structure of the anchor 4 in that the apex 42 terminates at a point, and also by the interaction between the anchor 4 and the connector piece 60. As can be seen in FIG. 1, when the tie is in the threading configuration, the anchor 4, the connector piece 60 and the ligament 5 are axially aligned with one another. This aligned arrangement forms an elongate unit that is substantially as long as the combined axial length of the anchor 4 and the connector piece 60. This makes the unit easier for a user to grip the scaffolding tie 1 to urge it into the scaffolding tarpaulin 8 to pierce it. Moreover, the anchor 4 and the connector piece 60 are arranged so that an axial force applied to the connector piece 60 in the direction of the anchor 4 causes engagement of the connector piece 60 with the anchor 4. Whilst the schematic view of FIG. 1 shows a slight separation between the anchor 4 and the connector piece 60 that is bridged by the ligament 5, in practice, urging the connector piece 60 towards the anchor 4 causes engagement between the upper end 64 of the nose 63 of the connector piece 60 and the base 41 of the anchor 4. The general compliance of the ligament 5 allows it to be axially compressed so that the separation between the anchor 4 and the connector piece 60 is closed under the application of force by a user to drive the anchor 4 and connector piece 60 together. At the same time, the compressed ligament 5 does not extend circumferentially beyond any radially-outwardly facing surface of the anchor 4, and so does not interfere with threading of the anchor 4 through the opening in the scaffolding tarpaulin 8 formed by piercing. Thus an axial force can be transmitted from the connector piece 60 to the anchor 4, and this can be used to drive the anchor 4 through a scaffolding tarpaulin 8.

The anchor 4 is driven from an internally-facing surface 83 of the tarpaulin 8, which faces the scaffolding pole 9, through to an externally-facing surface 84 of the tarpaulin 8 which faces outward relative to the general scaffolding structure of which the pole 9 is part. When the anchor 4 has passed completely through the tarpaulin 8, the scaffolding tie 1 can be switched from the threading configuration, as shown in FIG. 1, to the anchoring configuration, as shown in FIG. 2. In part, this is achieved by manually deflecting the ligament 5 and the anchor 4 out of axial alignment with one another so that the stowable portion 52 of the ligament 5 extends from the central region 72 of the anchor in an orientation that is transverse to the longitudinal orientation of the anchor 4. Moreover, the anchor 4 lies flat along the eyelet 80 and the externally-facing surface 84 of the tarpaulin 8 adjacent to the eyelet 80, and is able to draw the tarpaulin 8 towards the scaffolding structure located on the side of the internally-facing surface 83 of the tarpaulin 8. This is achieved via the biasing action of the ligament 5 in combination with the constrictable loop defined by the fastening means 2, as will be described further below.

As mentioned, the fastening means 2 is in the general form of a cable tie, and so is a separate component to the connector piece 60, and so is completely unconnected initially to the other components of the scaffolding tie 1 such as the ligament 5 and the anchor 4. As such, a user typically needs to connect the fastening means 2 to the connector piece 60 prior to completing connection of the tie 1 between the tarpaulin 8 and the pole 9.

Connection of the fastening means 2 to the connector piece 60 is carried out in two stages by a user. In a first stage, the tail 20 is threaded through the chamber 3 of the connector piece 60 by passing it into the third opening 35, through the second slot 32 and out of the second opening 34. Drawing the tail 20 of the fastening means 2 completely through the second slot 32 pulls the head 21 of the fastening means into the trench 30. The head 21 is small enough to fit into the trench 30 but too large to pass through the second slot 32 and so is caught within the trench 30. Moreover, the trench walls 37, 38, 39*a*, 39*b* and gully 36 define a seat into which the head 21 of the fastening means 2 locates when the tail 20 of the fastening means 2 is fully threaded through the second slot 32. The seat positions the head 21 so that the head 21 is located at the intersection of the paths along which the first and second slots 31, 32 extend, and moreover, the mouth 22 of the head 21 is aligned with the path along which the first slot 31 extends. This position is that shown in FIG. 1.

In a second stage of connecting the fastening means 2 to the connector piece 60, the tail 20 of the fastening means 2 is looped back and urged into the first opening 33 of the connector piece 60. Thus, the tail 20 is guided by the first slot 31 towards and through the mouth 22 of the head 21 of the fastening means 2 to form a complete loop. The locking member 23 cooperates with the ribs 25 disposed on the band portion 24 of the tail 20 so that the further feeding of the tail 20 through the head 21 constricts the loop, but an attempt to withdraw the tail 20 in the reverse direction is restrained by the locking member 23. This position is that shown in FIG. 2.

As also shown in FIG. 2, in use, the fastening means 2 is looped by a user around the scaffolding pole 9 and so serves to connect the connector piece 60 and the scaffolding pole 9 to one another. Moreover, the ratchet mechanism 26 allows the loop defined by the fastening means 2 to be irreversibly tightened, drawing the connector piece 60 and the scaffolding pole 9 together. This can be achieved quickly and easily by a user by pulling on the part of the tail 20 that has already passed through the head 21 of the fastening means 2. As shown in FIG. 2, this part accessibly protrudes through the third opening 35 of the connector piece 60.

As mentioned, the first and second slots 31, 32 lead into the trench 30 at offset positions, and this is to compensate for the relative position of the mouth 22 and the interface between the head 21 and the tail 20. Accordingly, it is preferred in use that the tail 20 of the fastening means 2 is first threaded through the second slot 32. However, in an alternative use, it is also possible for the tail 20 of the fastening means 2 to be first threaded through the first slot 31. Whilst this does not cause the most optimal alignment the head 21 and mouth 22, the second slot 32 does still guide the looped-back tail 20 into the mouth 22 of the fastening means 2. Thus, both the first and second slots 31, 32 effectively guide the looped-back tail 20 into the mouth 22 of the fastening means 2.

In either case, constricting the loop defined by the fastening means 2 shortens the effective length of the scaffolding tie 1 so that the part of the scaffolding tarpaulin 8 to which the tie 1 is anchored is drawn towards the scaffolding pole 9. This tensions the elastic ligament 5, thereby biasing the scaffolding pole 9 and the scaffolding tarpaulin 8 towards one another. Thus, the biasing action of the ligament 5 in combination with the constrictable loop defined by the fastening means 2 provides a quick and effective way of connecting the scaffolding pole 9 to the scaffolding tarpaulin 8.

It is envisaged that such an operation will typically be carried out many times by a scaffolder, with a plurality of scaffolding ties defining multi-point attachments between one or more scaffolding tarpaulins and a scaffolding structure.

Alternatives to, and advantages of the above-described tie will be apparent to a person skilled in the art.

For example, in alternatives, the apex may have other piercing constructions. For example, the apex may taper to an edge, and/or be shaped in the form of a drill bit. Accordingly, the anchor and/or the connector piece may be provided with grip-structures such as ridges to improve the manual grip with which a user can leverage such a piercing construction—namely via a twist-push action.

The use of retaining means such as pins in combination with a blind bore in the anchor and the connector piece is particularly useful during the manufacture of the scaffolding tie. The blind bore limits the depth of insertion of the ligament into the blind bore, thereby reliably ensuring a consistent length of ligament is retain within the bore, and also a consistent length can be provided outside the bore. A pin is then simply plunged into place. Nonetheless, in alternatives, other retaining means may be used to retain the ligament to the anchor and/or the connector piece. For example, staples may take the place of the pins described in relation to the tie of FIG. 1. Furthermore, adhesive may be applied within the blind bores of the anchor and/or connector piece either in addition to the pins or staples, or instead of them, to retain the ligament therein.

Notably, the retaining means should ideally be chosen to provide a predetermined binding force between the ligament and the anchor and/or connector piece. This is so that the scaffolding tie breaks at high wind speeds to enable scaffolding tarpaulin to come away from the underlying scaffolding structure. This is a safety feature that reduces the chance that the scaffold will be damaged or toppling due to the influence of excessive wind forces.

As mentioned, the fastening means represents a separate component that is to be connected, in use, to the connector piece, ligament and anchor (which are combined together during manufacturing of the scaffolding tie). In alternatives, the fastening means may be manufactured so that it is combined in advance with the connector piece, or even integral with it. However, in preferred alternatives, the fastening means is a separate component. This is because it is a relatively inexpensive component that can be cheaply replaced, facilitating reuse of a relatively costly connector piece, ligament and anchor of the scaffolding tie. Specifically, before a scaffolding structure is deconstructed, the scaffolding tarpaulin can be quickly decoupled from scaffolding poles by cutting through the fastening means to achieve quick release of the tarpaulin. The anchor, ligament and connector piece of the scaffolding tie can then be retrieved from the released tarpaulin, or simply left lying in position across the eyelet for subsequent use of the tarpaulin and tie.

A scaffolding tie 1*c* in accordance with a first embodiment of the present invention will be described in relation to FIGS. 10 to 27.

In general terms, the scaffolding tie 1*c* of the first embodiment has broadly similar major components of that already described in relation to the scaffolding tie 1 of FIGS. 1 to 9, including an elastic ligament 5*c* connected between an anchor 4*c* and an attachment portion 6*c*.

Corresponding reference numerals are used to denote corresponding features. However, in the interests of brevity, the following description will focus on the differences between the embodiments of the present invention, and the prior known scaffolding tie 1, as shown in FIGS. 1 to 9. It will be appreciated, nonetheless, that many of the features and advantages of the invention are shared with the prior known scaffolding tie 1.

Figure 10:
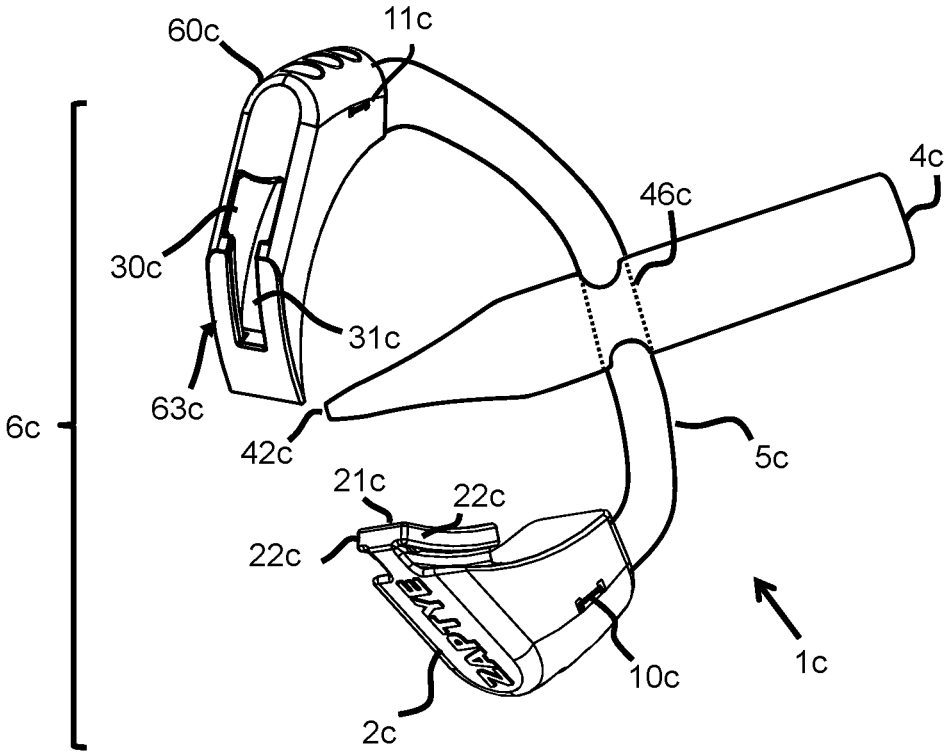
FIG. 10 is a perspective schematic view of a scaffolding tie according to a first embodiment of the present invention, the tie comprising an anchor, a ligament, a connector piece and a fastening means.
Figure 11:
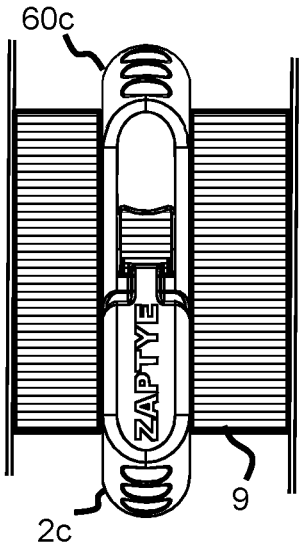
FIG. 11 is a front schematic view of the scaffolding tie of FIG. 10, the scaffolding tie being shown schematically connected to a scaffolding pole.
Figure 12:
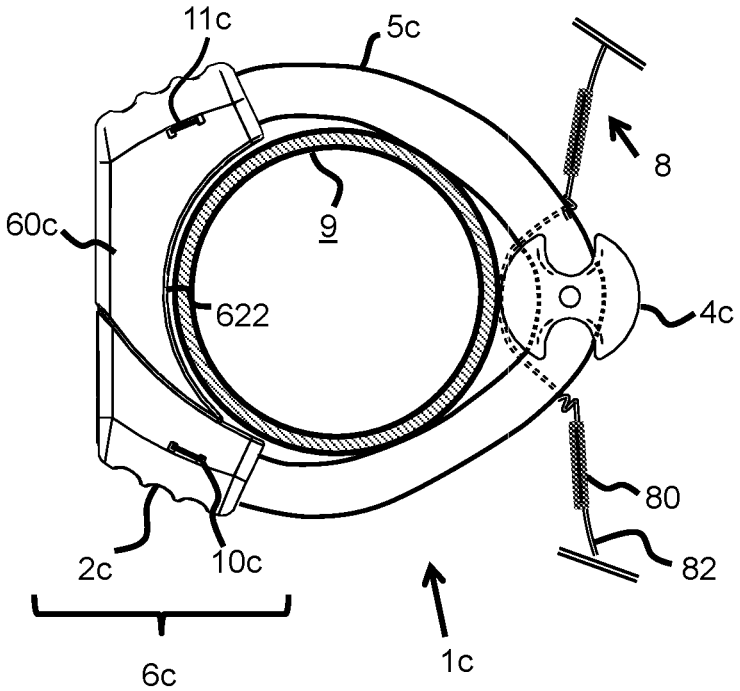
FIG. 12 is a front view of the scaffolding tie of FIG. 11, the scaffolding tie being shown schematically together with the scaffolding pole and a scaffolding tarpaulin, the scaffolding tie being in a threading configuration.
Figure 13:
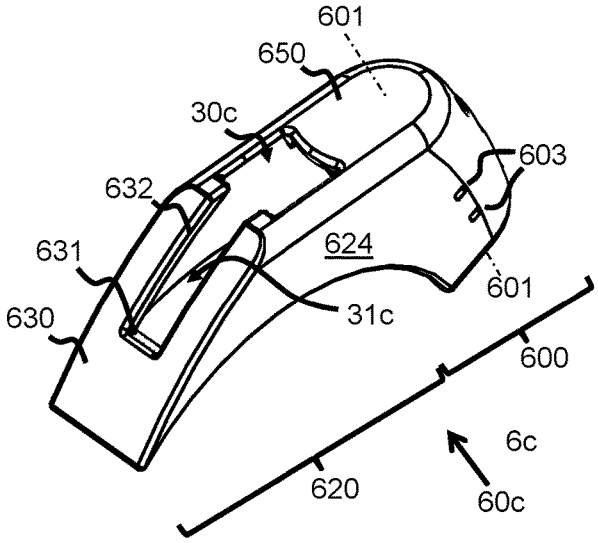
FIG. 13 is a schematic overhead right perspective view of the connector piece of the scaffolding tie of FIG. 10, the connector piece being shown in isolation.
Figure 14:
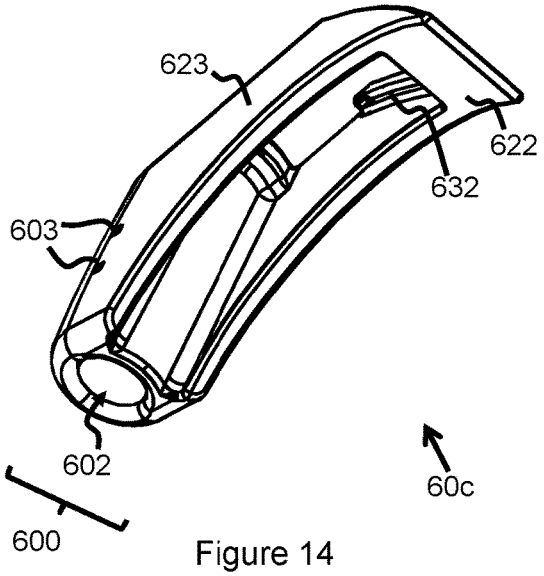
FIG. 14 is a schematic underneath left perspective view of the connector piece of FIG. 13.

Referring to FIGS. 10 to 12, the scaffolding tie 1*c* comprises an elastic ligament 5*c*, an anchor 4*c* and an attachment portion 6*c*. The attachment portion 6*c* comprises a connector piece 60*c* and a fastening means 2*c*. The fastening means 2*c* differs from previous examples in that it is not in the form of a cable tie. Rather, the fastening means 2*c* comprises a body moulded from an integral piece of plastics material that defines a latch 21*c*. In complement, the connector piece 60*c* comprises a body moulded from an integral piece of plastics material that defines a keep 63*c* for receiving the latch 21*c*.

Referring to FIGS. 13 to 18, which show the connector piece 60*c* in isolation, the connector piece 60*c* broadly comprises a barrel portion 600 and a claw portion 620 that are integrally-formed with one another. In general, the connector piece 60*c* of the present embodiment is formed from an integral piece of plastics material as this provides cost and strength advantages.

Figure 15:
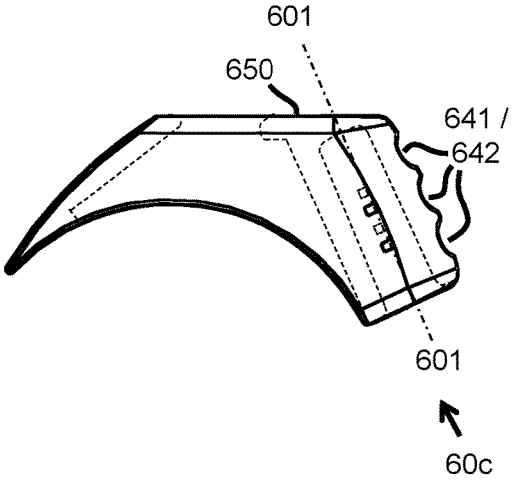
FIG. 15 is a schematic right side view of the connector piece of FIG. 13.
Figure 16:
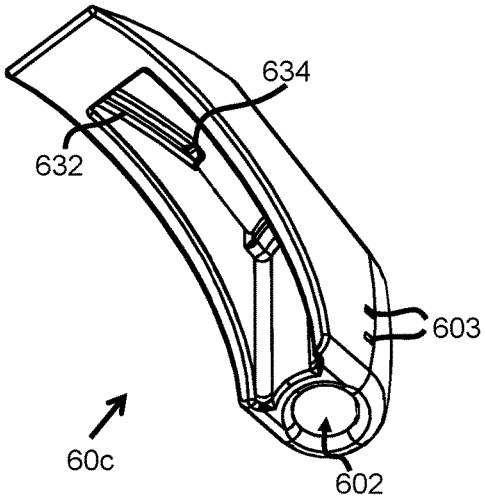
FIG. 16 is a schematic underneath right perspective view of the connector piece of FIG. 13.
Figure 17:
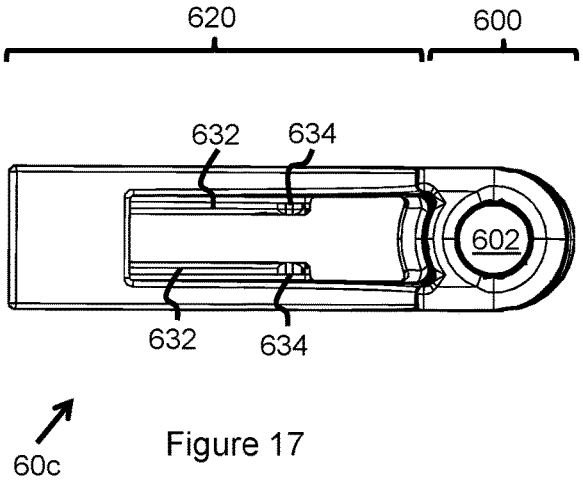
FIG. 17 is an schematic underneath view of the connector piece of FIG. 13.
Figure 18:
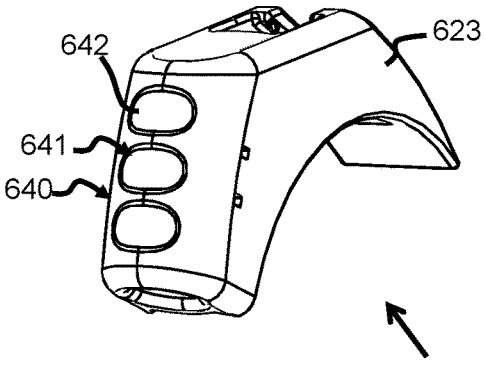
FIG. 18 is an schematic rear perspective view of the connector piece of FIG. 13.
Figure 19:
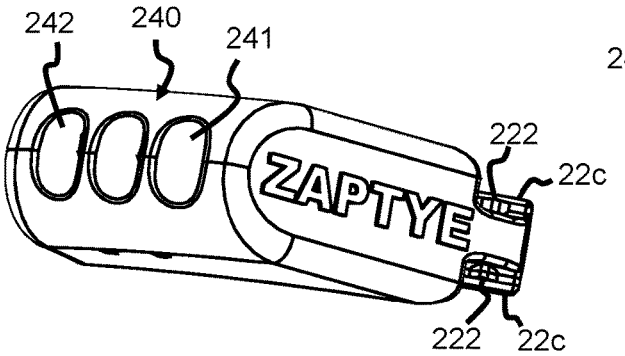
FIG. 19 is a schematic overhead perspective view of the fastening means of the scaffolding tie of FIG. 10, the fastening means being shown in isolation.
Figure 20:
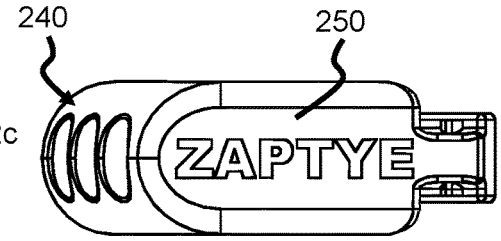
FIG. 20 is a schematic overhead view of the fastening means of FIG. 19.
Figure 21:
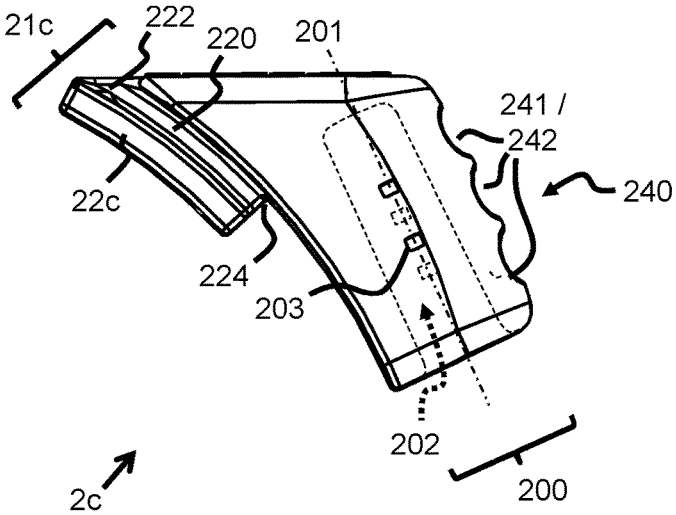
FIG. 21 is a schematic right side view of the fastening means of FIG. 19.
Figure 22:
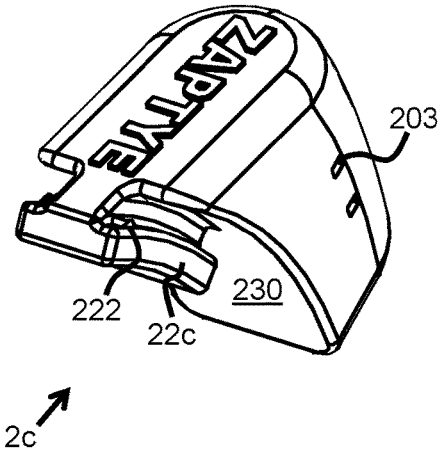
FIG. 22 is a schematic overhead right perspective view of the fastening means of FIG. 19.
Figure 23:
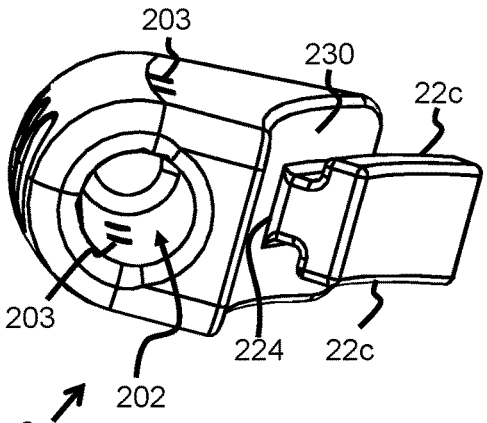
FIG. 23 is a schematic underneath left perspective view of the fastening means of FIG. 19.
Figure 24:
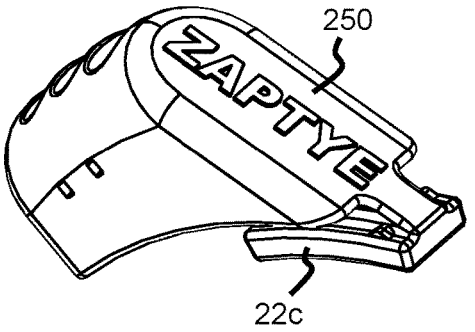
FIG. 24 is a schematic left perspective view of the fastening means of FIG. 19.

The barrel portion 600 is broadly cylindrical in shape with a longitudinal axis 601, capped by a roof 650 at an upper end, and open at the opposite lower end, and so arranged to define a blind bore 602 centred on the longitudinal axis 601 of the barrel portion 600. The barrel portion 600 is arranged to receive and allow permanent attachment to one end of the ligament 5*c*. This is achieve during manufacture of the tie 1*c* via insertion of that end of the ligament into the bore 602, and then securement via driving staples or pins through staples apertures 603 defined in the side walls of the barrel portion 600. As these extend transverse to the longitudinal axis 601 of the barrel portion 600, these prevent the end of the ligament 5*c* from being withdrawn following insertion of the staples or pins. As can be seen in FIG. 15, there are two sets of staple apertures 603, one set on each side, and these are offset from one another to prevent staples from interfering with one another. The bore opening has a rounded mouth, and slightly tapers inwardly to facilitate insertion and securement of the ligament 5*c*.

The barrel portion 600 comprises a rear part 640 having concave dimples 642 defined on its surface. These effectively define finger grips 641 that facilitate manual one-handed operation of the tie 1*c*.

The barrel portion 600 transitions into the claw portion 620 that broadly comprises a curved contact surface 622, an arched left side wall 623, an arched right side wall 624, and a ramp 630. The ramp 630 is situated at an upper region of the connector piece 60*c*, and transitions into the roof 650 of the barrel portion 600.

The claw portion 620 defines the entrance 30*c* and the slit 31*c* into which a latch 21*c* of the fastening means 2*c* is received, as will be described. The entrance 30*c* defines a wide opening that leads to the relatively narrow slit 31*c*, which then terminates at a seat 631 where the ramp 630 meets and is interrupted by the end of the slit 31*c*. As the width of the slit 31*c* is narrower than the width of the ramp 630, and so defines a pair of rails 632 running along the length of the slit 31*c*. A pair of indents 634 are set into the underside of the rails 632, close to the region where the slit 31*c* transitions to the entrance 30*c*. These features of the claw portion and in particular the entrance 30*c*, slit 31*c*, ramp 630, seat 631 and rails 632 define the keep 63*c* into which the latch 21*c* of the fastening means is received.

Referring to FIGS. 19 to 24, which show the fastening means 2*c* in isolation, the fastening comprises a broadly-cylindrical barrel portion 200 similar to that of the barrel portion 600 of the connector piece 60*c*. Likewise, the barrel portion 200 of the fastening means 2*c* has a longitudinal axis 201, defines a blind bore 202 and staple apertures 203. The arrangement of these are similar to those already described above in relation to the connector piece 60*c*.

The fastening means 2*c* also comprises the latch 21*c* which is shaped and configured to latch on to the cooperating structures of the connector piece 60*c*. The latch 21*c* comprises laterally-extending wings 22*c* supported by a central neck 220 of the latch 21*c*. A pair of lugs 222 are situated near to the top of the wings 22*c*, the lugs 222 having a humpback that protrudes from the curvature of the underlying upper surface of the wings 22*c*.

The lugs 222 of the fastening means, and the indents 634 of the connector piece 60*c* define registration formations: They are complementary in shape and positioned so that they cooperate to register the fastening means 2*c* and the connector piece 60*c* to one another when they are connected to one another. Moreover, as the fastening means 2*c* and the connector piece 60*c* are latched together, the registration formations click into place. This provides tactile feedback to a user that demonstrates that the tie 1*c* is secured. Furthermore, the registration formations alter the sliding frictional force that is required to move the fastening means and the connector piece into or out from the connected configuration. A greater force is required to dislodge the fastening means 2*c* and the connector piece 60*c* from one another when so connected. This increases the reliability with which the fastening means 2*c* and the connector piece 60*c* are secured to one another.

The neck 220 of the latch 21*c* extends from a curved shoulder 230 of the fastening means 2*c* between a roof 250 at an upper end, and a base 224 of the neck 220 at a lower end. The roof 250 is broadly planar, and supports embossed lettering spelling "ZAPTYE".

The fastening means 2*c* also comprises a rear part 240, similar to that of the connector piece 60*c*, the rear part 240 having finger grips defined by dimples 242 set into rear part as before.

Broadly, the latch 21*c* and the keep 63*c* define complementary interconnection structures that are arrange to slide along one another between a connected configuration in which the fastening means and the connector piece are connected to one another and a disconnected configuration in which the fastening means and the connector piece are disconnected from one another. Naturally, the connection is reversible, allow repeated connection and disconnection, and so allowing reuse of the tie 1*c*.

Referring back to FIGS. 10 to 12, the connector piece 60*c* and fastening means 2*c* are attached at opposed ends of the ligament 5*c*, with the anchor 4*c* between them. Thus, and as shown in FIG. 12, when the keep 63*c* and the latch 21*c* are engaged with one another, the scaffolding tie 1*c* defines a loop that can be attached around a scaffolding pole 9. As described previously in relation to FIGS. 1 to 9, the anchor 4*c* can be threaded through a scaffolding tarpaulin 8 so that the tarpaulin can be maintained in position relative to the pole 9, with a pointed apex 42*c* being first used by a user to puncture the webbing 82 in the region of the eyelet 80 as described before.

However, unlike previous examples, the ligament 5*c* is connected to the connector piece 60*c* at one end, and the fastening means 2*c* at the other end with the anchor 4*c* being provided in-between. The anchor 4*c* is not fixed in place to the ligament 5*c*. Instead, the anchor 4*c* defines a ligament channel 46*c* through which the elastic ligament 5*c* passes. The anchor 4*c* is therefore connected to the ligament 5*c* by virtue of capturing it within the ligament channel 46*c*. The ligament channel 46*c* is wide enough to allow the anchor 4*c* to slide freely along the ligament 5*c*, between the connector piece 60*c* and fastening means 2*c*. Advantageously, this allows the relative positioning between the anchor 4*c* and the attachment portion 6*c* to be changed, for example to accommodate different relative position of the tarpaulin, pole and user access to the attachment portion 6*c*.

Each respective end of the ligament 5*c* is fixed to the connector piece 60*c* and the fastening means 2*c* respectively. Moreover, the ligament 5*c* ends are fixed in position by a respective set of pins or staples 11*c*, 10*c*. The connector piece 60*c* and the fastening means 2*c* have bores into which respective ends of the ligament 5*c* can be fed into during manufacture to retain the ligament 5*c* in place for effective stapling, the staples being driven through staple apertures 603, 203 defined within the body of the connector piece 60*c* and the fastening means 2*c* respectively.

The keep 63*c* of the connector piece 60*c* and the latch 21*c* of the fastening means 2*c* are configured and arranged so that when the latch 21*c* and keep 63*c* are interlocked, the elastic force imparted by the elastic ligament 5*c* as it is stretched around a scaffolding pole 9 biases the fastening means 2*c* and the connector piece 60*c* toward locking engagement.

In particular, the keep 63*c* defines a trench that is T-shaped in cross-section. A complementarily-shaped latch 21*c* can fit into the trench via a T-shaped entrance 30*c* of the trench. The trench narrows to a slit 31*c* that captures wings 22*c* of the latch 21*c* behind it, within the trench.

The latch 21*c* is typically engaged with the keep 63*c* by overstretching the ligament 5*c* further around a scaffolding pole 9, partially overlapping the connector piece 60*c* and the fastening means 2*c*, allowing an end of the latch 21*c* to be fed into the entrance 30*c*. When fed in, the position and orientation of the latch 21*c* and the keep 63*c* relative to the respective ends of the ligament 5*c* cause the latch 21*c* and the keep 63*c* to be drawn into and biased into engagement with one another. Advantageously, this allows the tie 1*c* to be secured firmly in use, but also presents a quick and convenient way to disconnect the tie 1*c* after it has served its purpose. Moreover, it is possible to achieve one-handed disconnection of the tie 1*c*—all that is required is for a user to squeeze the fastening means 2*c*, and the connector piece 60*c*, between a thumb and forefinger across one another, thereby sliding the latch 21*c* of the fastening means 2*c* out of the keep 63*c* of the connector piece 60*c*. During sliding relative movement between the fastening means 2*c* and the connector piece 60*c*, the wings 22*c* of the fastening means 2*c* hook underneath and slide along the rails 632 of the connector piece 60*c*. Similarly, the lower curved shoulder 230 of the fastening means 2*c* slides over the ramp 630 of the connector piece 60*c*. In each case the curvature of the structures that are sliding along one another are such that facilitates coupling and decoupling of the fastening means 2*c* and connector piece 60*c*. Moreover, the curvature assists with at least partially circumferential movement of these component around the scaffolding pole 9 to which they may be attached.

The connector piece 60*c* comprises a body that defines a curved contact surface 622 that substantially conforms to the cylindrical outer surface of a scaffolding pole 9. The fastening means 2*c* also defines a curved surface for conformity with the pole 9. This reduces stresses on the components of the tie 1*c* when under force in use, increasing the reliability of the tie 1*c*.

The relative cooperating structures of the latch 21*c* and the keep 63*c* retain the fastening means 2*c* and the attachment portion 60*c* together in normal use—in particular, under forces transmitted through the elastic ligament 5*c* by relative movement of the tarpaulin and the pole 9.

Compared to prior examples, the present embodiment provides a significantly easier way to disengage the relative cooperating structures of the latch 21*c* and the keep 63*c*. Advantageously, this allow the full re-use of the scaffolding tie 1*c* without damage to it. This is in contrast with the prior presented example that necessitate disposal of the fastening means after it is cut to disengage the tarpaulin 8 from the pole 9.

Figure 25:
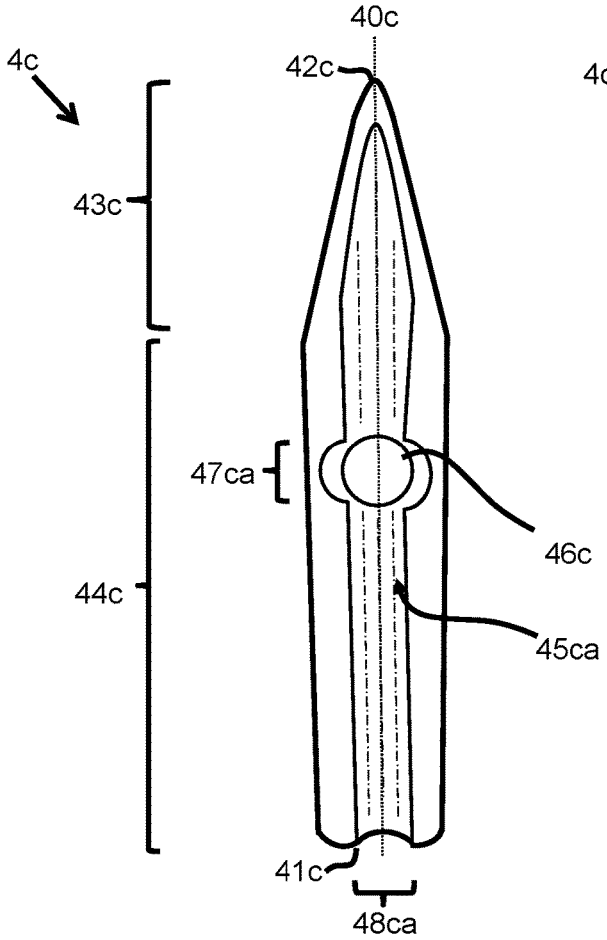
FIG. 25 is a schematic front view of the anchor of the scaffolding tie of FIG. 10, the anchor being shown in isolation.
Figure 26:
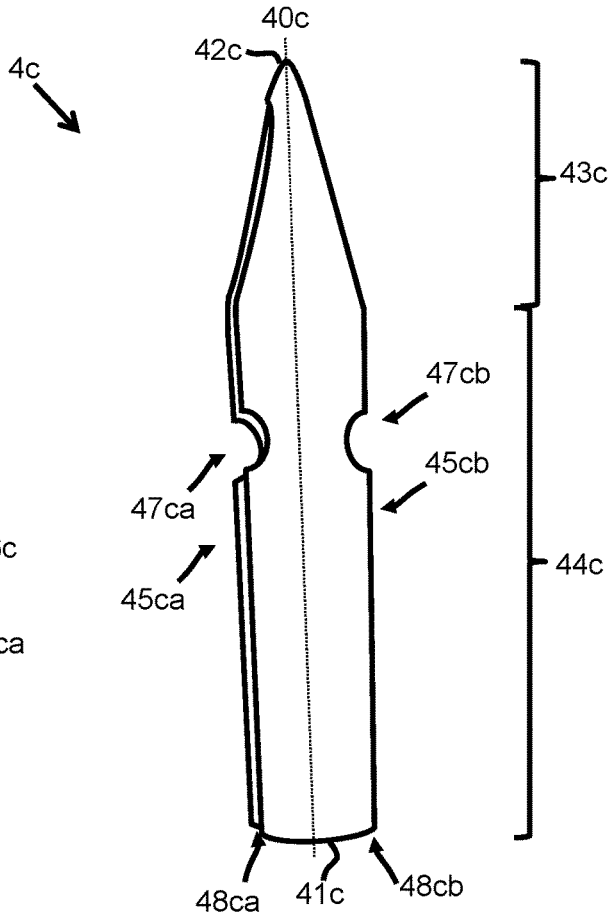
FIG. 26 is a schematic side view of the anchor of FIG. 25.
Figure 27:
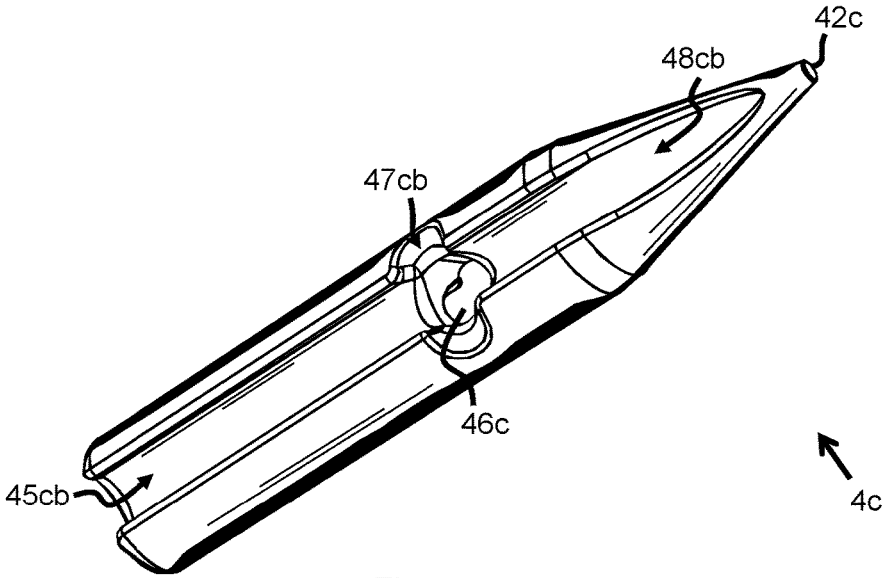
FIG. 27 is a schematic perspective view of the anchor of FIG. 25.

The anchor 4*d*, shown in isolation in FIGS. 25, 26 and 27, is formed from an inelastic integral piece of injection-moulded plastic, is elongate along a longitudinal axis 40*c*, as indicated by the dotted line, between a base 41*c* at one end of the anchor 4*c*, to an apex 42*c* at the other end of the anchor 4*c*.

In the axial direction from the apex 42*c* to the base 41*c*, the anchor 4*d* defines a leading section 43*c* and a trailing section 44*c*. An outer convex surface of the leading section 43*c* approximates to a frustrum which tapers outwardly from the apex 42*c*, approximately one third of the axial length of the anchor 4*c*, to the interface with the trailing section 44*c*. An outer convex surface of the trailing section 44*c* approximates to a frustrum, tapering gently inwards from the interface with the leading section 43*c* to the base 41*c*. The trailing section 44*c* occupies approximately two-thirds of the axial length of the anchor 4*c*. A ligament channel 46*c* is defined in the middle of the anchor, the ligament channel 46*c* being oriented perpendicular to the longitudinal axis 40*c* of the anchor 4*c*, and extending radially all the way through between diametrically-opposed regions of the outer convex surface of the trailing section 44*c*.

The anchor 4*c* is further interrupted by a pair of cross-grooves 45*ca*, 45*cb*, each centred on the ligament channel 46*c*, and set into the outer convex surface of the anchor 4*c* at diametrically-opposed regions, such that the anchor 4*c* is rotationally symmetrical about its axis 40*c*. Only one of the cross-grooves 45*ca* is visible in FIG. 25, the other 45*cb* being present on the rear perspective view shown in FIG. 27.

Each cross-groove 45*ca*, 45*cb* is formed from a respective short transverse groove 47*ca*, 47*cb*, and a respective longitudinal groove 48*ca*, 48*cb*, which extend linearly at right angles to one another, bisecting one another to form a cross that is centred on the ligament channel 46*c*. Each short transverse groove 47*ca*, 47*cb* is parallel to the other. Each longitudinal groove 48*ca*, 48*cb* is broadly parallel to the other and also the longitudinal axis 40*c* of the anchor 4*c*.

The short transverse grooves 47*ca*, 47*cb*, and the longitudinal grooves 48*ca*, 48*cb* each describe a concave indentation having an arcuate sectional profile into which the ligament 5*c* can be partly accommodated during manipulation of the tie 1*c*.

In a threading configuration, in which the anchor 4*c* is driven through an eyelet 80 of a tarpaulin 8 as described previously, the ligament 5*c* can be positioned within the longitudinal grooves 48*ca*, 48*cb* by a user. Specifically, as the ligament 5*c* extends through the ligament channel 46*c*, it effectively forms a loop with two lengths of ligament 5*c*, one being accommodated by each longitudinal groove 48*ca*, 48*cb*. Thus, the ligament 5*c* does not overly interfere with threading of the anchor 4*c* through the opening in the scaffolding tarpaulin 8 formed by puncturing it using the relatively pointed apex 42*c* of the anchor 4*c*.

The tie 1*c* can then be switched to an anchoring configuration. After the anchor 4*c* has been passed through the tarpaulin 8, the orientation between the anchor 4*c* and the ligament 5*c* can be switched so that the anchor 4*c* extends in a direction parallel to the plane in which the tarpaulin extends 8, with the ligament 5*c* extending transversely through the opening in the punctured tarpaulin 8.

When in the anchoring configuration, the ligament 5*c* is thus instead accommodated by the short transverse grooves 47*ca*, 47*cb*. The transverse grooves 47*ca*, 47*cb* define a narrower structure than other parts of the trailing section 44*c* around which the ligament loop can extend.

Advantageously, this reduces strain on the tarpaulin material surrounding the opening and furthermore retains the anchor 4*c* in position, preventing rotation of the anchor 4*c* and so anchor slippage. Thus, the transverse grooves, and in particular the short transverse grooves define anti-slippage structures to retain the anchor 4*c* reliably in place.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

The invention claimed is:

1. A scaffolding tie for connecting a scaffolding tarpaulin to a scaffolding pole, the tie comprising:

an anchor for anchoring the tie to the scaffolding tarpaulin;

an attachment portion for attaching the tie to a scaffolding pole; and a ligament connected between the anchor and the attachment portion, and arranged, in use, to bias the anchor and attachment portion towards one another; wherein, the attachment portion comprises a fastening means and a connector piece arranged, in use, to reversibly connect to one another to form a loop around a scaffolding pole, wherein the fastening means and the connector piece comprise complementary interconnection structures that are arranged to slide along one another between a connected configuration in which the fastening means and the connector piece are connected to one another and a disconnected configuration in which the fastening means and the connector piece are disconnected from one another, wherein the interconnection structures comprise rails along which at least one of the fastening means and the connector piece are slidable relative to the other.

2. A scaffolding tie according to claim 1, wherein the interconnection structures comprise a latch and a keep, the latch being receivable within the keep and retained therein when the fastening means and the connector piece are connected to one another.

3. A scaffolding tie according to claim 1, wherein the interconnection structures comprise registration formations to register the fastening means and the connector piece relative to one another when they are in the connected configuration.

4. A scaffolding tie according to claim 3, wherein the registration formations are arranged to provide tactile feedback to user when the fastening means and the connector piece are moved into or out from the connected configuration.

5. A scaffolding tie according to claim 3, wherein the registration formations are arranged to alter the sliding frictional force that is required to move the fastening means and the connector piece into or out from the connected configuration, the sliding frictional force being greater than that required to move the fastening means and the connector piece between the disconnected configuration and the connected configuration.

6. A scaffolding tie according to claim 1, wherein the fastening means and the connector piece latch on to one another when in a connected configuration.

7. A scaffolding tie according to claim 1, wherein the ligament is arranged, in use, to bias the fastening means and connector piece towards a connected configuration.

8. A scaffolding tie for connecting a scaffolding tarpaulin to a scaffolding pole, the tie comprising:

an anchor for anchoring the tie to the scaffolding tarpaulin;

an attachment portion for attaching the tie to a scaffolding pole; and a ligament connected between the anchor and the attachment portion, and arranged, in use, to bias the anchor and attachment portion towards one another; wherein, the attachment portion comprises a fastening means and a connector piece arranged, in use, to reversibly connect to one another to form a loop around a scaffolding pole, wherein the fastening means and the connector piece each comprise a barrel portion having a bore into which respective ends of the ligament are received and permanently connected to the fastening means or the connector piece.

9. A scaffolding tie according to claim 8, wherein the ligament is permanently connected to at least one the fastening means and connector piece via at least one pin, the pin extending through the ligament and the barrel portion of the at least one of the fastening means and connector piece.

10. A scaffolding tie according to claim 9, wherein the pin extending through the barrel portion at an angle transverse to a longitudinal axis of the barrel portion.

11. A scaffolding tie according to claim 8, wherein the bore of the barrel portion is a blind bore.

12. A scaffolding tie according to claim 8, wherein an open end of each barrel portion from which a respective end of the ligament emerges is spaced from respective interconnection structures of the fastening means or the connector piece.

13. A scaffolding tie according to claim 1, wherein the fastening means and the connector piece each comprise a respective rear part which are each arranged so that squeezing the rear part together, when the fastening means and the connector piece are interconnected, slides the fastening means and the connector piece along one another toward a disconnected configuration.

14. A scaffolding tie according to claim 1, wherein at least one of the rear parts comprise finger grips shaped and arranged to facilitate manual handling of the tie.

15. A scaffolding tie according to claim 13, shaped and arranged to allow the rear parts to be squeezed together using a thumb and forefinger of a user, thereby to allow one-handed decoupling of the fastening means and the connector piece.

16. A scaffolding tie for connecting a scaffolding tarpaulin to a scaffolding pole, the tie comprising:

an anchor for anchoring the tie to the scaffolding tarpaulin;

an attachment portion for attaching the tie to a scaffolding pole; and a ligament connected between the anchor and the attachment portion, and arranged, in use, to bias the anchor and attachment portion towards one another; wherein, the attachment portion comprises a fastening means and a connector piece arranged, in use, to reversibly connect to one another to form a loop around a scaffolding pole, wherein the anchor comprises at least one anti-slippage structure arranged to prevent slippage of the anchor relative to the ligament, when the tie is in an anchoring configuration, and the ligament extends in an orientation transverse to the anchor.

17. A scaffolding tie according to claim 16, wherein the at least one anti-slippage structure comprises at least one groove defined within the anchor, in which the ligament is accommodated when the tie is in an anchoring configuration.

18. A scaffolding tie according to claim 17, wherein the groove is located at a relatively narrow part of the anchor.

19. A scaffolding tie according to claim 16, comprising a pair of anti-slippage structures, each for accommodating a different portion of the ligament.

* * * * *